US010647139B1

(12) United States Patent
Kitahara

(10) Patent No.: US 10,647,139 B1
(45) Date of Patent: May 12, 2020

(54) PRINTER AND RIBBON WINDING FEATURES

(71) Applicant: TOSHIBA TEC KABUSHIKI KAISHA, Shinagawa-ku, Tokyo (JP)

(72) Inventor: Satoshi Kitahara, Sunto Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/264,726

(22) Filed: Feb. 1, 2019

(51) Int. Cl.
*B41J 33/24* (2006.01)
*B41J 2/325* (2006.01)

(52) U.S. Cl.
CPC ..... *B41J 33/24* (2013.01); *B41J 2/325* (2013.01)

(58) Field of Classification Search
CPC .. B41F 16/00; B41F 16/0006; B41F 16/0026; B41F 16/0033; B41J 2/315; B41J 2/32; B41J 2/325; B41J 33/24
See application file for complete search history.

(56) References Cited

U.S. PATENT DOCUMENTS 7,474,323 B2 * 1/2009 Sawada ..... B41J 17/36 347/213
8,264,512 B2 9/2012 Michizuki
9,399,956 B2 7/2016 Cowgill et al.
9,434,178 B1 * 9/2016 Shimosato ..... B41J 2/325
9,623,683 B2 * 4/2017 Kojima ..... B41J 2/325
10,035,367 B1 7/2018 Yap et al.
2018/0281489 A1 10/2018 Hojo

FOREIGN PATENT DOCUMENTS

GB 2404896 2/2005

OTHER PUBLICATIONS

Extended European Search Report for European Patent Application No. 19159123.9 dated Oct. 7, 2019.

* cited by examiner

*Primary Examiner* — Kristal Feggins
(74) *Attorney, Agent, or Firm* — Amin, Turocy & Watson, LLP

(57) ABSTRACT

A printer contains a ribbon holding shaft; a ribbon winding shaft; a printing section to print using an ink ribbon and a print head; a winding motor to rotationally drive the ribbon winding shaft; a damper section, provided on a conveyance path of the ink ribbon; a controller to control an operation of the ribbon winding shaft at the start of driving by increasing an input voltage applied to the winding motor; a detection section configured to detect movement of the damper section; a calculation section to calculate a winding diameter of the ink ribbon on the ribbon winding shaft side using the input voltage when the movement of the damper section is detected and characteristics of the damper section; and a voltage determination section to determine an input voltage to be applied to the motor according to the calculated winding diameter.

20 Claims, 9 Drawing Sheets

PRINTER AND RIBBON WINDING FEATURES

FIELD

Embodiments described herein relate generally to a printer and ribbon winding features of a ink ribbon employed by the printer.

BACKGROUND

A thermal printer of a thermal transfer system is widely used as a printer such as a barcode printer or a label printer, which transfers ink coated on an ink ribbon with a thermal head by melting the ink by heat. As a result, in a printer using the ink ribbon, an unused ink ribbon fed from a ribbon holding shaft is wound by a ribbon winding shaft through a printing position where a thermal head and a platen face each other to perform thermal transfer. On the other hand, a print medium is conveyed by a conveyance section, but it is desired that the ink ribbon and the print medium are conveyed synchronously in the same direction and at the same speed at the above-mentioned printing position, thereby preventing rubbing and dirt and further improving printing quality.

Conventionally, there is a method of detecting a rotation speed of each rotation shaft using an encoder that detects transmitted light by providing a slit in each of the ribbon winding shaft and the ribbon holding shaft or a gear attached to each rotation shaft, and further calculating a ribbon diameter (a winding diameter of the ink ribbon) for each shaft. As a result, the printer applies an input voltage corresponding to the ribbon diameter at that time to a motor for driving each rotation shaft and controls a torque of each rotation shaft, thereby controlling a conveyance speed and tension of the ribbon and further improving the printing quality.

However, at the time of turning on a power supply or at a time point before the start of the conveyance of the ink ribbon immediately after the ink ribbon is replaced, since the rotation shafts do not rotate, the ribbon diameter cannot be calculated. Therefore, conventionally, at the start of conveyance of the ink ribbon, an intermediate value between the ribbon diameter at the start of use of the ink ribbon and the ribbon diameter at the time when there is no ink ribbon is used to set an initial input voltage applied to the motor which corresponds to the ribbon diameter.

As a result, since the initial input voltage is set using the ribbon diameter different from the actual ribbon diameter, there is a case in which the motor input voltage at the start of the winding operation of the ink ribbon does not match the actual ribbon diameter. There is also a problem that wrinkles occur in the ink ribbon and phenomena such as smudge generated as the ribbon and the paper are not synchronized in speed and are rubbed and stained occur. Therefore, conventionally, a technology capable of more appropriately setting the motor input voltage at the start of the winding operation of the ink ribbon is desired.

DETAILED DESCRIPTION

In light of the above-described problems in thermal printing, a technology capable of more appropriately setting the motor input voltage at the start of the winding operation of the ink ribbon is desired and provided herein.

In accordance with an embodiment, a printer comprises a ribbon holding shaft around which an ink ribbon is wound; a ribbon winding shaft around which the ink ribbon pulled out from the ribbon holding shaft is wound; a printing section configured to perform printing using the ink ribbon and a print head on a print medium conveyed to a printing position where the print head and a platen face each other; a winding motor configured to rotationally drive the ribbon winding shaft; a damper section, provided on a conveyance path of the ink ribbon from a position where the ink ribbon is pulled out from the ribbon holding shaft to a position where the ink ribbon is wound around the ribbon winding shaft through the printing position, configured to elastically abut against the ink ribbon when the conveyance of the ink ribbon is stopped; a controller configured to control an operation of the ribbon winding shaft at the start of driving by increasing an input voltage applied to the winding motor in stages; a detection section configured to detect that the damper section moves; a calculation section configured to calculate a winding diameter of the ink ribbon at the ribbon winding shaft using the input voltage when the movement of the damper section is detected and characteristics of the damper section; and a voltage determination section configured to determine an input voltage to be applied to the motor according to the calculated winding diameter.

Hereinafter, an embodiment of a printer is described in detail with reference to the accompanying drawings. In the embodiment described below, an example in which a label printer which performs printing on a label paper is applied as the printer is described. The embodiment described below is an embodiment of a printer, and does not intend to limit the configuration and the specification thereof.

Figure 1:
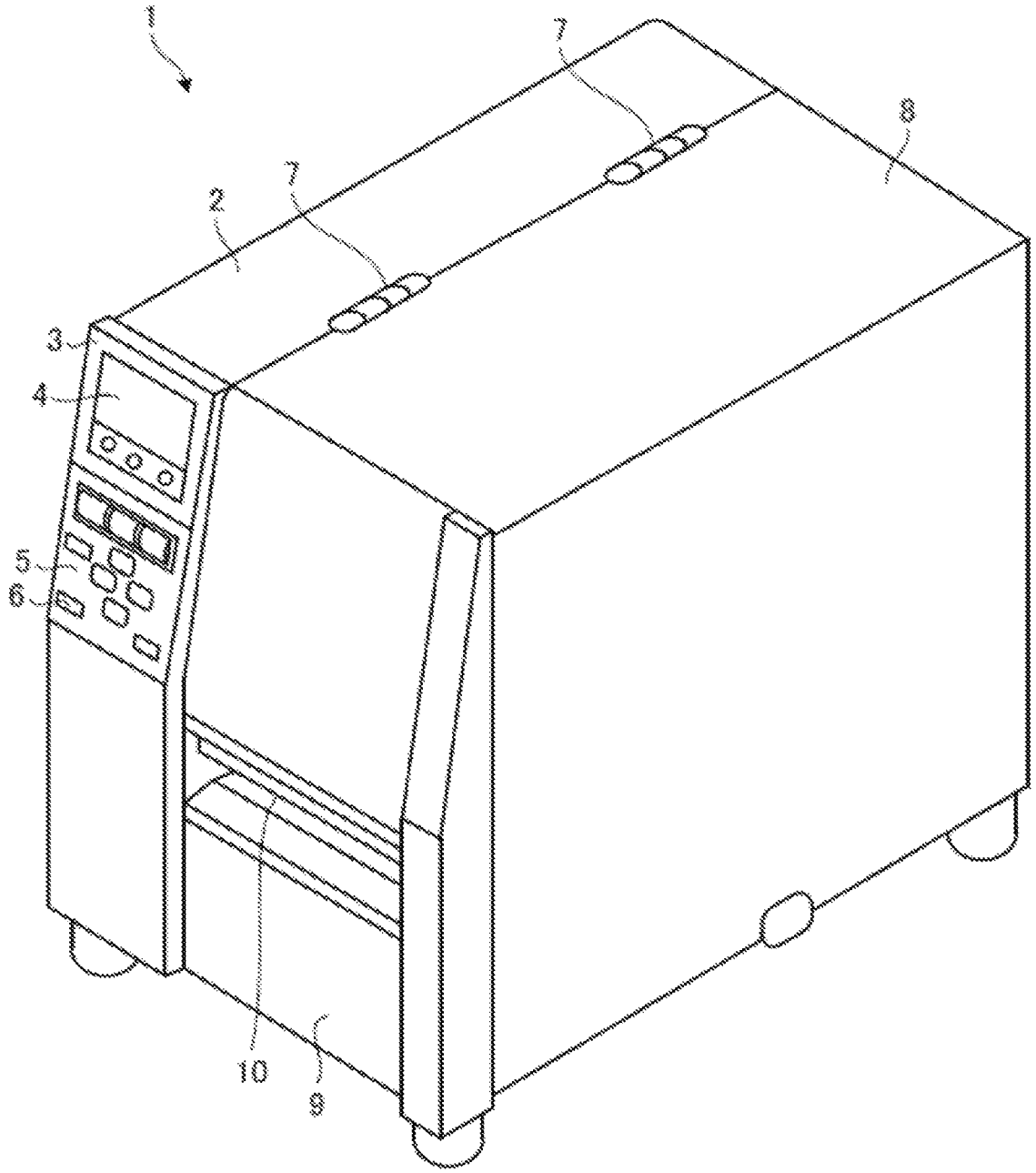
FIG. 1 is a perspective view illustrating an external appearance of a printer according to an embodiment.

FIG. 1 is a perspective view illustrating an external appearance of a printer 1 according to the embodiment. As shown in FIG. 1, the printer 1 includes a casing 2 on the left side, and a casing 8 connected to the right side of the casing 2 with a hinge 7. A front panel 3 of the casing 2 has a display section 4 and an operation section 5. The display section 4 is a liquid crystal display attached with a backlight, but other types of display devices may be used as the display section 4. The operation section 5 includes a plurality of operation buttons 6.

The casing 8 on the right side can largely open the inside of a housing (i.e., the casings 2 and 8) by pivoting the hinge 7. As described later with reference to FIG. 2, the printer 1 has a label paper 20 wound in a roll shape, an ink ribbon 30 stretched around two shafts, and a printing section 23 for performing printing on the ink ribbon (refer to FIG. 2 for all of them) in the housing. Therefore, by pivoting the hinge 7 to raise the casing 8 towards an upper portion, it is easy to replace the ink ribbon 30 and the label paper 20 (refer to FIG. 2) or to facilitate internal maintenance. In a front panel 9 of the casing 8, a label issuing port 10 is provided. The printer 1 issues a label after printing from the label issuing port 10.

Figure 2:
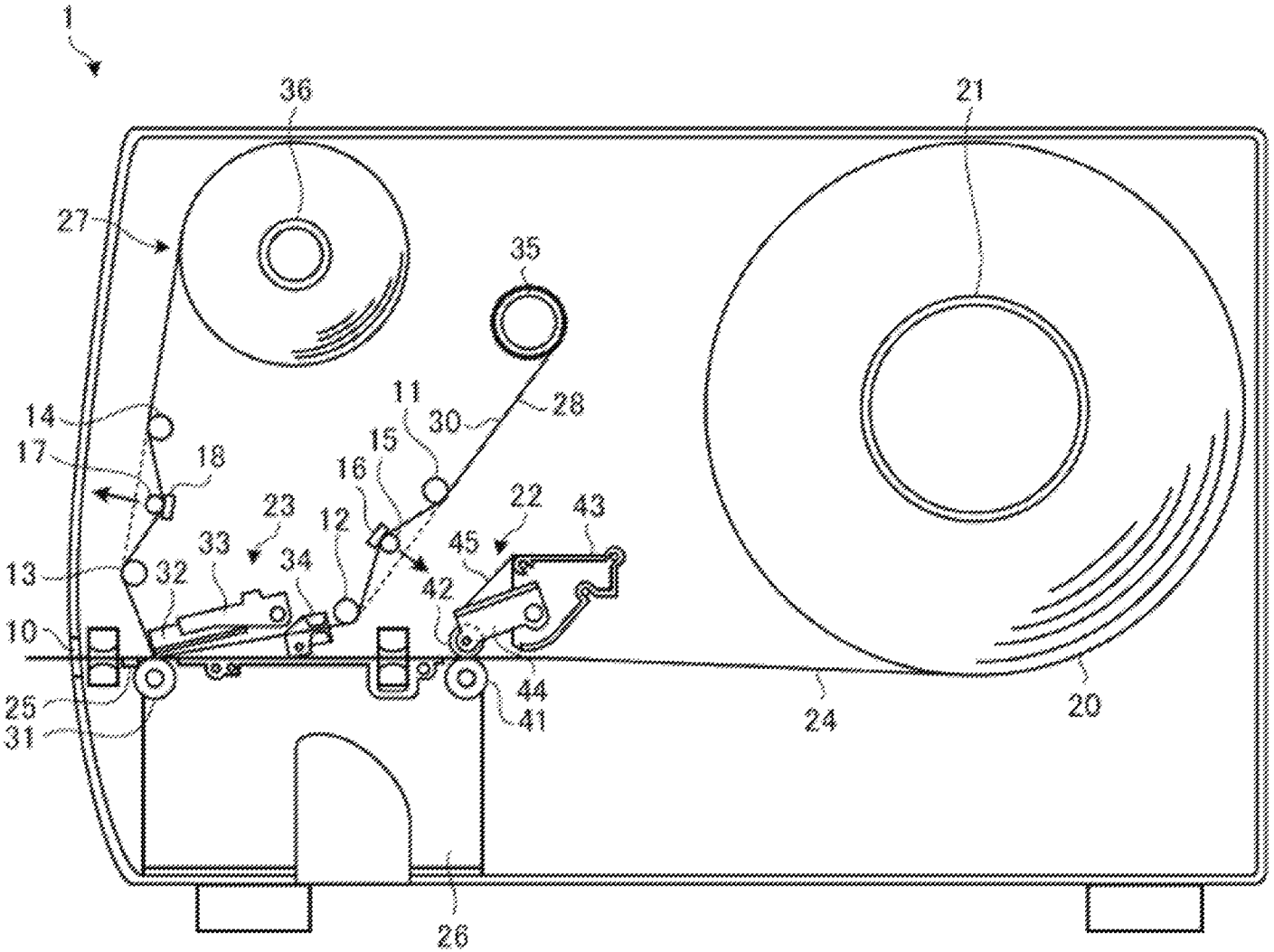
FIG. 2 is a sectional view schematically illustrating an example of an internal configuration of the printer.
Figure 3:
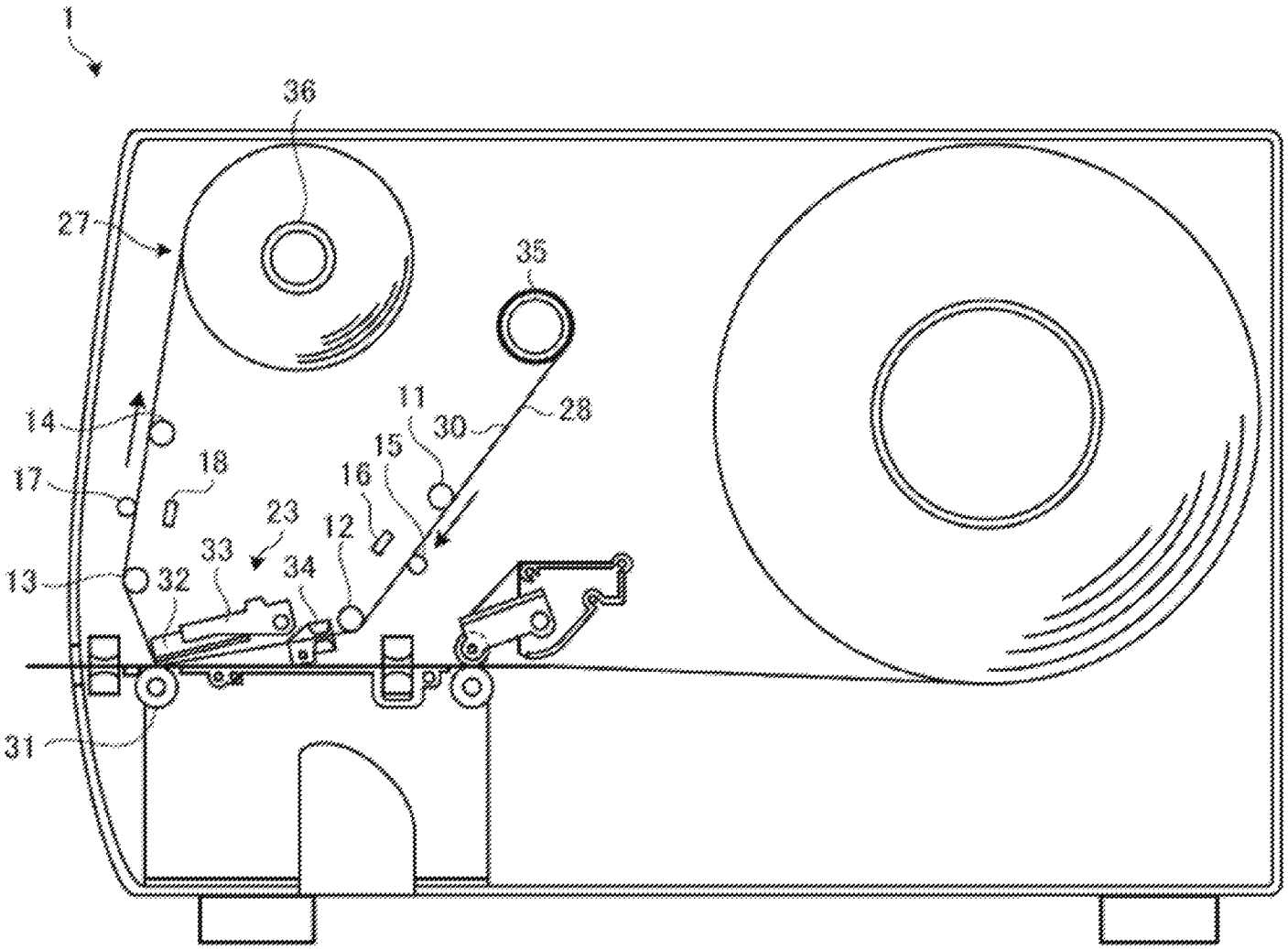
FIG. 3 is a diagram illustrating a conveyance path and a position of a damper section when the ink ribbon is being conveyed.

FIG. 2 and FIG. 3 are cross-sectional views schematically illustrating an example of an internal configuration of the printer 1. FIG. 2 shows a state in which the conveyance of the ink ribbon 30 is stopped. FIG. 3 shows a state in which the ink ribbon 30 is being conveyed. As shown in FIG. 2 and FIG. 3, the printer 1 mainly includes a paper holding shaft 21, a paper conveyance section 22, the printing section 23, a frame 26 and an ink ribbon supply device 27 in the housing thereof.

The paper holding shaft 21 is a shaft around which the label paper 20 is wound and held in a roll shape. The label paper 20 is pulled out from the paper holding shaft 21 and finally discharged from the label issuing port 10 after printing by the printing section 23 via the paper conveyance section 22. The label paper 20 may be a label paper formed by affixing a label to a mount. The print medium is not limited to the label paper 20, and the paper holding shaft 21 may hold another print medium. As an example of another print medium, a tag paper which is thick and card-shaped printing paper may be used.

The paper conveyance section 22 mainly includes a paper conveyance roller 41, a pinch roller 42, a frame 43, a support section 44 and a leaf spring 45. The pinch roller 42 is rotatably supported by the support section 44. The paper conveyance roller 41 and the pinch roller 42 abut against each other across the label paper 20 conveyed along the conveyance path 24. The paper conveyance roller 41 is rotatably attached to the frame 26 and is driven by a driving structure (not shown) to rotate.

The support section 44 is attached to the frame 43 in a shakable manner. One end of the leaf spring 45 is attached to the frame 43, and the other end of the leaf spring 45 abuts against the pinch roller 42. The pinch roller 42 is energized by the leaf spring 45 to abut against the paper conveyance roller 41.

The printing section 23 mainly includes a platen 31 and a print head 32 which is a line type thermal printer head. The configuration of the print head 32 may be any configuration as long as it corresponds to a printing method used by the print head 32. For example, in the case of a printer of an impact dot system, the print head 32 of the impact dot system is used. The platen 31 is rotatably attached to the frame 26 and is driven to rotate by a driving section (not shown).

The print head 32 is fixed to a head holding section 33 rotatably attached to a frame (not shown).

The conveyance path 24 of the label paper 20 starts from a location where the label paper 20 is pulled out from the paper holding shaft 21. The conveyance path 24 passes through a position at which the pinch roller 42 and the paper conveyance roller 41 abut against each other in the paper conveyance section 22. Further, the conveyance path 24 is terminated at the label issuing port 10 through a position (printing position) where the print head 32 and the platen 31 of the printing section 23 abut against each other.

In the conveyance path 24, a label peeling plate 25 is provided on a downstream side in a conveyance direction with respect to the printing section 23. The label peeling plate 25 bends the label paper 20 being conveyed to separate the label and the mount. The mount after separation is wound around a winding shaft (not shown), while the label after separation from the mount is issued from the label issuing port 10.

Next, the ink ribbon supply device 27 is described.

The ink ribbon supply device 27 mainly includes a ribbon holding shaft 35, a ribbon winding shaft 36 and a ribbon end sensor 34. The unused ink ribbon 30 is wound around the ribbon holding shaft 35 in a roll shape.

The ink ribbon supply device 27 is provided with guide rollers 11 and 12 on the ribbon holding shaft 35 side, and guide rollers 13 and 14 on the ribbon winding shaft 36 side. The ink ribbon supply device 27 includes a damper section 15 on the ribbon holding shaft side, and a damper section 17 on the ribbon winding shaft 36 side. The ink ribbon supply device 27 includes a damper sensor 16 on the ribbon holding shaft 35 side, and a damper sensor 18 on the ribbon winding shaft 36 side.

The guide rollers 11 and 12 are rotatably attached to the frame (not shown). The guide rollers 11 and 12 guide the ink ribbon 30 pulled out from the ribbon holding shaft 35. By providing the guide rollers 11 and 12, the conveyance path between the two rollers is fixed, and thus, even if the ribbon diameter on the ribbon holding shaft 35 side changes, a positional relationship between the ink ribbon 30 and the damper section 15 does not change.

The guide rollers 13 and 14 are rotatably attached to the frame (not shown). The guide rollers 13 and 14 guide the ink ribbon 30 after transfer at the printing position where the print head 32 and the platen 31 face each other to the ribbon winding shaft 36. By providing the guide rollers 13 and 14, the conveyance path between the two rollers is fixed, and thus, even if the ribbon diameter on the ribbon winding shaft 36 side changes, a positional relationship between the ink ribbon 30 and the damper section 17 does not change.

As a result, regardless of whether the conveyance of the ink ribbon 30 is stopped or the ink ribbon 30 is being conveyed, the guide rollers 11 to 14 abut against the ink ribbon 30 to maintain the conveyance path of the ink ribbon 30.

The damper section 15 is arranged on a conveyance path 28 of the ink ribbon 30 from a position where the ink ribbon 30 is pulled out from the ribbon holding shaft 35 to a position where the ink ribbon 30 is wound around the ribbon winding shaft 36 through the printing position. The damper section 17 (second damper section) is arranged on the conveyance path 28 of the ink ribbon 30 from the printing position to a ribbon winding end of the ribbon holding shaft 35. The damper sections 15 and 17 having elastic characteristics (elastic modulus, elastic force) are arranged at positions where they elastically abut against the ink ribbon 30 at the time of stop of conveyance.

Here, the conveyance path of the ink ribbon 30 and the operations of the damper sections 15 and 17 in both the state in which the ink ribbon 30 is conveyed and the state in which the conveyance of the ink ribbon 30 is stopped are described with reference to FIG. 2 and FIG. 3, respectively. In FIG. 2, a solid line between the guide rollers 11 and 12 and a solid line between the guide rollers 13 and 14 indicate positions of the ink ribbon 30 when conveyance of the ink ribbon 30 is stopped. A dotted line between the guide rollers 11 and 12 and a dotted line between the guide rollers 13 and 14 indicate positions of the ink ribbon 30 when the ink ribbon 30 is being conveyed.

As shown in FIG. 2, since a tension of the ink ribbon 30 is relaxed when the conveyance of the ink ribbon 30 is stopped, the ink ribbon 30 is pressed by elastic forces of the damper sections 15 and 17 at the positions indicated by the solid line between the guide rollers 11 and 12 and the solid line between the guide rollers 13 and 14. The ink ribbon 30 is pressed by the damper sections 15 and 17 at positions where the tension of the ink ribbon 30 balances with the elastic forces of the damper sections 15 and 17.

At the start of conveyance of the ink ribbon 30, the tension of the ink ribbon 30 increases as a driving force from DC (direct current) motors (a winding motor 84 and a feed motor 83 described later with reference to FIG. 7) is applied, and the position of the ink ribbon 30 changes from the position indicated by the solid line in FIG. 2 to a position indicated by the dotted line in FIG. 2 or FIG. 3. As the tension of the ink ribbon 30 increases, the damper sections 15 and 17 are pushed out by the ink ribbon 30 to move towards an outer circumferential direction of the conveyance path 28. In other words, as shown in FIG. 3, the damper sections 15 and 17 are separated from the ink ribbon 30 during the conveyance of the ink ribbon.

The damper sections 15 and 17 need not be completely separated from the ink ribbon 30 at the time of conveyance of the ink ribbon, and may abut against the ink ribbon 30 with elastic forces thereof to such an extent that they do not interfere with the conveyance of the ink ribbon 30. In this case, the damper sections 15 and 17 at the time of conveyance of the ink ribbon are also located at positions different from those at the time of stop of the conveyance of the ink ribbon.

As a result, if the tension of the ink ribbon 30 increases, the positions of the damper sections 15 and 17 change from the positions shown in FIG. 2 to positions shown in FIG. 3. The damper sensors 16 and 18 respectively detect the movement of the damper sections 15 and 17.

The damper sensors 16 and 18 are mechanical switch mechanisms to detect change in the positions of the damper sections 15 and 17 (i.e., movement of the damper sections 15 and 17) before and after the start of conveyance of the ink ribbon.

In a state in which the conveyance of the ink ribbon 30 is stopped and the tension of the ink ribbon 30 is lower, the damper sensors 16 and 18 are arranged at positions where the damper sensors 16 and 18 respectively contact with the damper sections 15 and 17 and the damper sensors 16 and 18 are turned on. On the other hand, when the tension of the ink ribbon 30 increases, and the conveyance of the ink ribbon 30 is started, the ink ribbon 30 pushes back the damper sections 15 and 17 to move them. Therefore, the damper sections 15 and 17 and the damper sensors 16 and 18 are respectively separated from each other, and the damper sensors 16 and 18 are turned off. As a result, the damper sensors 16 and 18 can detect the movement of the damper sections 15 and 17.

In this way, in the present embodiment, by providing the damper sections 15 and 17, paths (positions) of the ink ribbon 30 are different when the ink ribbon is being conveyed and when the conveyance of the ink ribbon is stopped. The change in the path of the ink ribbon 30 can be detected by detecting the change in the positions of the damper sections 15 and 17 by the damper sensors 16 and 18.

In FIG. 2 and FIG. 3, the damper sections 15 and 17 press the ink ribbon 30 towards the inside of the conveyance path 28 when the conveyance is stopped. However, the arrangement of the damper sections 15 and 17 and the damper sensors 16 and 18 is not limited thereto.

Figure 4:
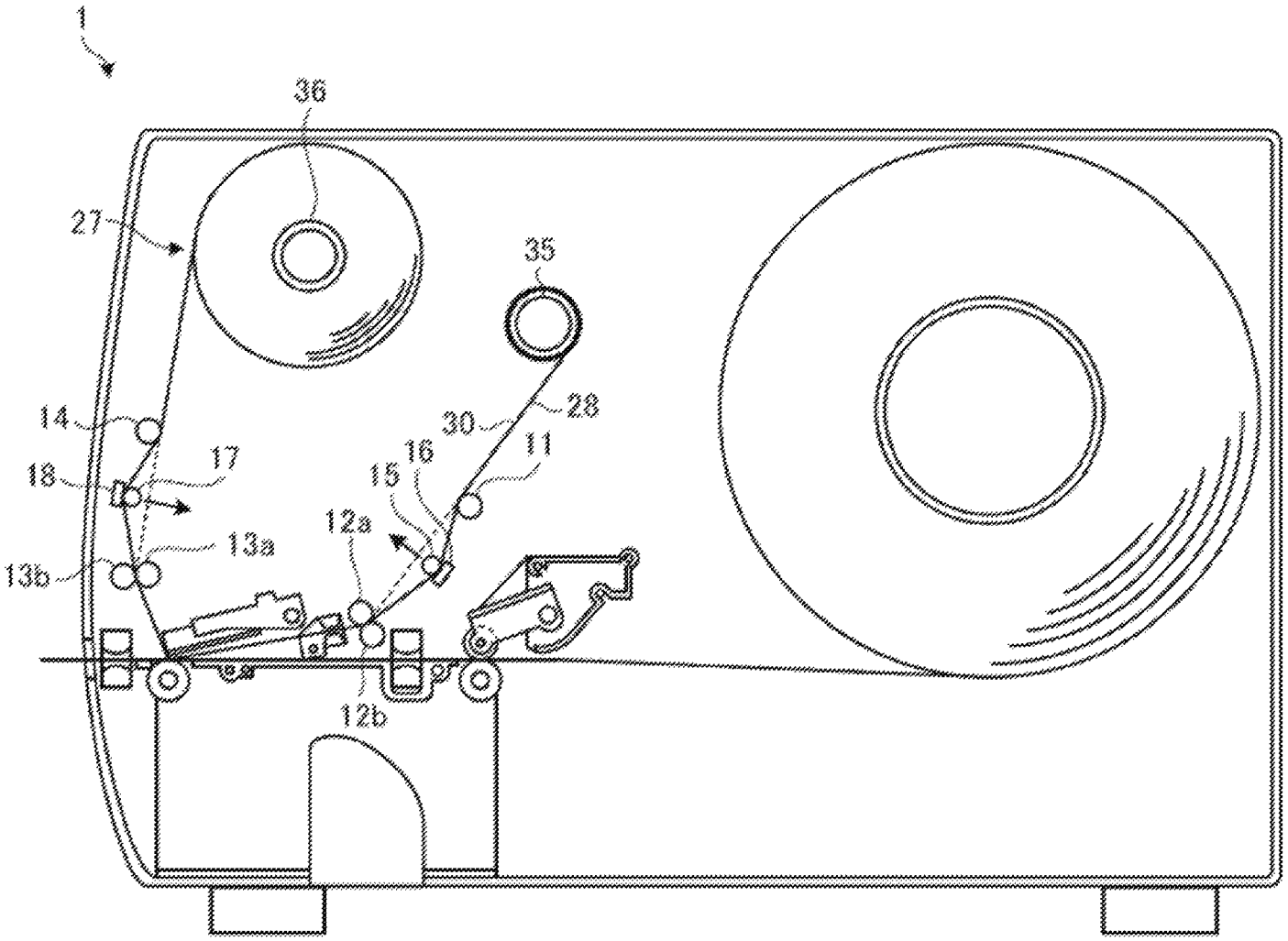
FIG. 4 is a diagram illustrating another example of arrangement of the damper section and a damper sensor.

FIG. 4 is a diagram illustrating another example of the arrangement of the damper sections 15 and 17 and the damper sensors 16 and 18. As shown in FIG. 4, the guide rollers 11, 12*a*, 12*b*, 13*a*, 13*b* and 14 and the damper sections 15 and 17 may be arranged so as to distort the conveyance path 28 of the ink ribbon 30 towards the outer side thereof when the conveyance of the ink ribbon is stopped. In this case, when the conveyance of the ink ribbon 30 is stopped, the damper sections 15 and 17 press the ink ribbon 30 towards the outer circumferential direction of the conveyance path 28 due to the elasticity thereof. Then, if the input voltage applied to the DC motor (i.e., the winding motor 84 and the feed motor 83 in FIG. 7) gradually increases, and the tension of the ink ribbon 30 balances with the elastic forces of the damper sections 15 and 17, the damper sections 15 and 17 move in a direction indicated by an arrow in FIG. 4, respectively, and the damper sensors 16 and 18 detect the movement of the damper sections 15 and 17, respectively.

Returning to FIG. 2 and FIG. 3, the conveyance path of the ink ribbon 30 is described.

If the conveyance of the ink ribbon 30 is started, the ink ribbon 30 before printing abuts against the guide rollers 11 and 12 on the ribbon holding shaft 35 side, then passes through a detection target area of the ribbon end sensor 34, and reaches the printing position where the print head 32 and the platen 31 abut against each other. The transfer is performed by the print head 32 on the ink ribbon 30. After printing, the ink ribbon 30 abuts against the guide rollers 13 and 14 on the ribbon winding shaft 36 side, and is then wound around the ribbon winding shaft 36 to be recovered.

Specifically, the conveyance path 28 of the ink ribbon 30 starts from a position where the ink ribbon 30 is pulled out from the ribbon holding shaft 35, and passes through the positions where the ink ribbon abuts against the guide rollers 11 and 12 on the ribbon holding shaft 35 side. Then, the conveyance path 28 sequentially passes through the detection target area of the ribbon end sensor 34 and the position where the print head 32 and the platen 31 abut against each other (i.e., the printing position). Furthermore, the conveyance path 28 passes through the positions where the ink ribbon 30 abuts against the guide rollers 13 and 14 on the ribbon winding shaft 36 side, and is terminated at a portion where the ink ribbon 30 is wound around the ribbon winding shaft 36.

The ribbon end sensor 34 is used for detecting a ribbon end, i.e., an end of the ink ribbon 30. As shown in FIG. 2 and FIG. 3, the ribbon end sensor 34 is arranged on the conveyance path 28 between the printing section 23 and the ribbon holding shaft 35. As shown in FIG. 2 and FIG. 3, the ribbon end sensor 34 is preferably arranged along the conveyance path 28 of the ink ribbon 30, and between the printing section 23 and the guide roller 12 on the conveyance path 28. More preferably, the ribbon end sensor 34 is provided between the position where the print head 32 and the platen 31 abut against each other in the printing section 23 (i.e., the printing position, or a transfer position) and the guide roller 12.

Next, an example of structures of the damper sections 15 and 17 is described. The structures of the damper sections 15 and 17 are the same, and thus, the structure of the damper section 17 shown below can be applied to the structure of the damper section 15.

Figure 5:
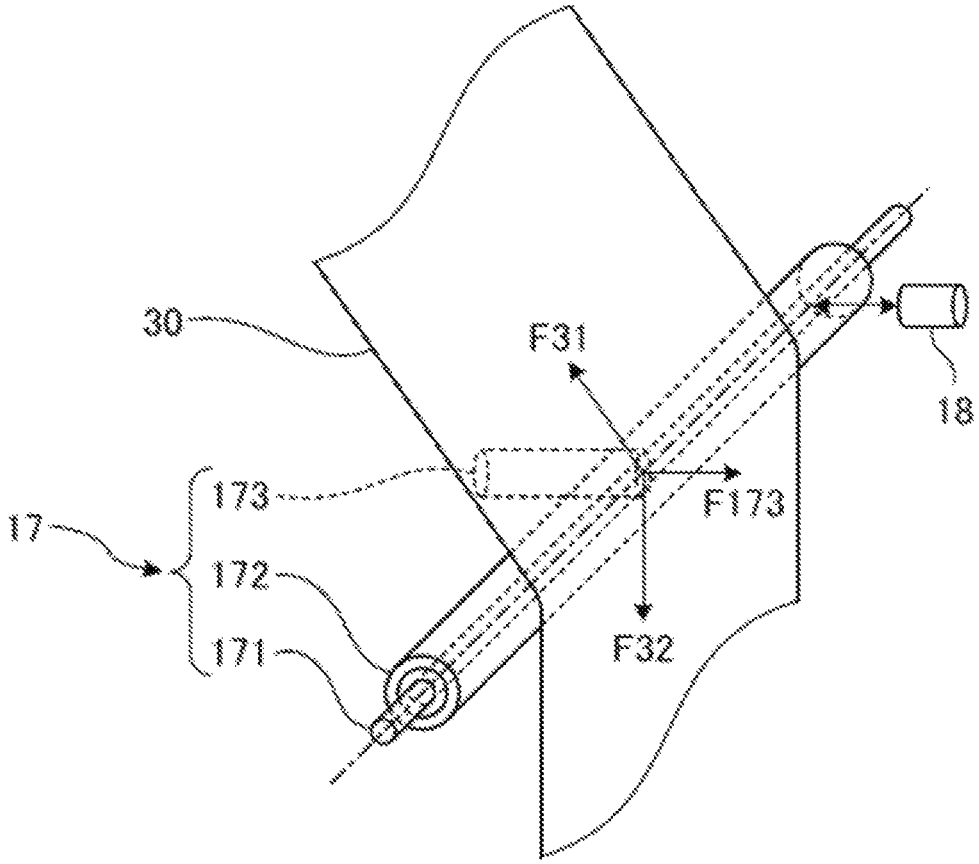
FIG. 5 is a diagram (perspective view) schematically illustrating an example of a configuration of the damper section.

FIG. 5 is a diagram (perspective view) schematically illustrating an example of the structure of the damper section 17. As shown in FIG. 5, the damper section 17 includes a shaft 171, a cylindrical portion 172 and a damper 173.

The cylindrical portion 172, which is hollow, is made of a resin having a straw-like shape. The shaft 171 made of metal passes through the inside of the cylinder of the cylindrical portion 172, and the shaft 171 is held by a holding section (not shown). The shaft 171 is shakable in a lateral direction in FIG. 5, and is held with a position thereof being variable in the lateral direction in FIG. 5 according to the tension of the ink ribbon 30.

The sizes of the outer diameter of the shaft 171 and the inner diameter of the cylindrical portion 172 are formed in such a manner that a gap can be formed between an outer circumferential surface of the shaft 171 and an inner circumferential surface of the cylindrical portion 172, and the cylindrical portion 172 is provided to be rotatable around the shaft 171. The cylindrical portion 172 can rotate as the ink ribbon 30 is conveyed. Since the cylindrical portion 172 is made of a resin which has a small coefficient of friction, the conveyance speed of the ink ribbon 30 is not influenced even when the damper section 17 abuts against the ink ribbon 30.

The damper 173 is arranged at a position where it abuts against the cylindrical portion 172 by an elastic force F173 thereof. The damper section 17 may have a plurality of dampers 173. If there is a plurality of dampers 173, the elastic force F173 is a resultant force of the elastic forces of the respective dampers 173.

When the conveyance of the ink ribbon 30 is stopped, the tension of the ink ribbon 30 is small. Therefore, the damper section 17 (i.e., the damper 173, the cylindrical portion 172 and the shaft 171) moves to a position where a force of the damper 173 (elastic force F173) pressing the cylindrical portion 172 balances with a resultant force of the tension F31 and F32 of the ink ribbon 30. In the example in FIG. 5, the damper section 17 moves in the right direction in FIG. 5. The damper sensor 18 detects the movement of the damper section 17. If the damper sensor 18 is a sensor of a switch type, the damper sensor 18 is turned on to detect that the damper sensor 18 and the cylindrical portion 172 are in contact with each other.

On the other hand, at the start of conveyance of the ink ribbon 30 (immediately before conveyance), a torque of the DC motor is transmitted to the ink ribbon 30, and thus, the tension of the ink ribbon 30 increases. The resultant force of the tensions F31 and F32 of the ink ribbon 30 becomes larger than the elastic force F173 of the damper 173, and the damper section 17 (i.e., the damper 173, the cylindrical portion 172 and the shaft 171) moves in the left direction in FIG. 5. The damper sensor 18 detects that the damper section 17 moves away. Specifically, if the damper sensor 18 is the sensor of the switch type, the damper sensor 18 is turned off to detect that the damper sensor 18 and the cylindrical portion 172 are separated from each other.

The elastic force F173 applied by the damper 173 to the ink ribbon 30 (the cylindrical portion 172) is determined by the characteristics (elastic modulus) of the damper 173. The elastic modulus of the damper 173 is appropriately set according to the configuration of the printer 1 such as a state of an initial feed operation of the ink ribbon, a performance of start, a specification of the DC motor, a type of the ink ribbon, and the like.

For example, in a case in which the elastic force F173 of the damper 173 of the damper section 17 is 400 gf, when the input voltage applied to the DC motor gradually increases and the resultant force of the tension F31 and F32 of the ink ribbon 30 becomes 400 gf, the elastic force F173 and the resultant force of the tension F31 and F32 balance with each other. At this time, (elastic force F173)*(ribbon radius) (torque immediately before the ribbon shaft rotates) (Equation 1) is established. Here, the ribbon radius refers to a winding radius on the ribbon winding shaft 36 side. The torque refers to the torque of the ribbon winding shaft 36 in the example in FIG. 5. The torque immediately before the ribbon shaft rotates is derived from torque characteristics of the DC motor (the winding motor 84) shown below.

Figure 6:
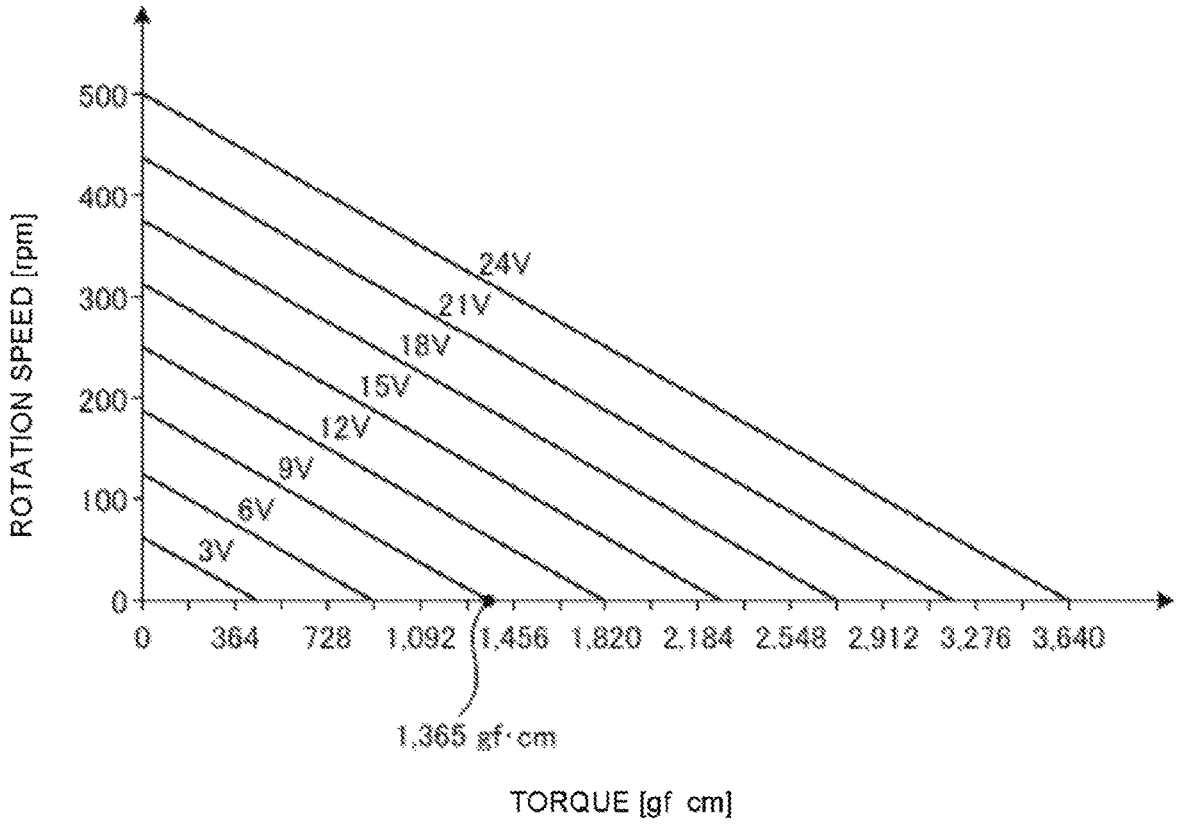
FIG. 6 is a diagram illustrating an example of torque characteristics of a DC motor.

FIG. 6 is a diagram illustrating an example of torque characteristics of the DC motor. A vertical axis indicates a rotation speed [rpm] for each input voltage applied to the DC motor, and a horizontal axis indicates a torque [gf·cm] for each input voltage applied to the DC motor. The characteristics shown in FIG. 6 can be applied to both the rotation speed of the ribbon winding shaft 36 for each input voltage applied to the winding motor 84 and the rotation speed of the ribbon holding shaft 35 for each input voltage applied to the feed motor 83. Below, the above description is continued using an example of the input voltage applied to the winding motor 84 and the torque of the ribbon winding shaft 36.

As shown in FIG. 6, the torque (horizontal axis) of the ribbon winding shaft 36 increases in accordance with the input voltage applied to the DC motor (i.e., the winding motor 84). Similarly, the torque when the rotation speed is 0 rpm, i.e., just before the ribbon shaft (the ribbon winding shaft 36 in this case) starts to rotate takes a value corresponding to the input voltage applied to the DC motor (the winding motor 84). For example, if the input voltage applied to the winding motor 84 is 9 V, the torque immediately before the ribbon winding shaft 36 starts to rotate (i.e., when the rotation speed is 0 rpm) is 1,365 rpm in FIG. 6.

Therefore, from Equation 1, (ribbon radius)*400 [gf]=1, 365 [gf·cm], and the ribbon radius of the ribbon winding shaft 36 can be calculated to be 6.8 cm.

As a result, in the present embodiment, it is possible to calculate the winding diameter (ribbon diameter) of the ink ribbon 30 from the balance of the forces immediately before the rotation of the ribbon winding shaft 36 (at the start of rotation). Therefore, even when the ribbon diameter cannot be calculated by the encoder, it is possible to calculate the ribbon diameter and to set a more appropriate input voltage applied to the DC motor at the start of rotation.

Next, a hardware configuration of the printer 1 is described.

Figure 7:
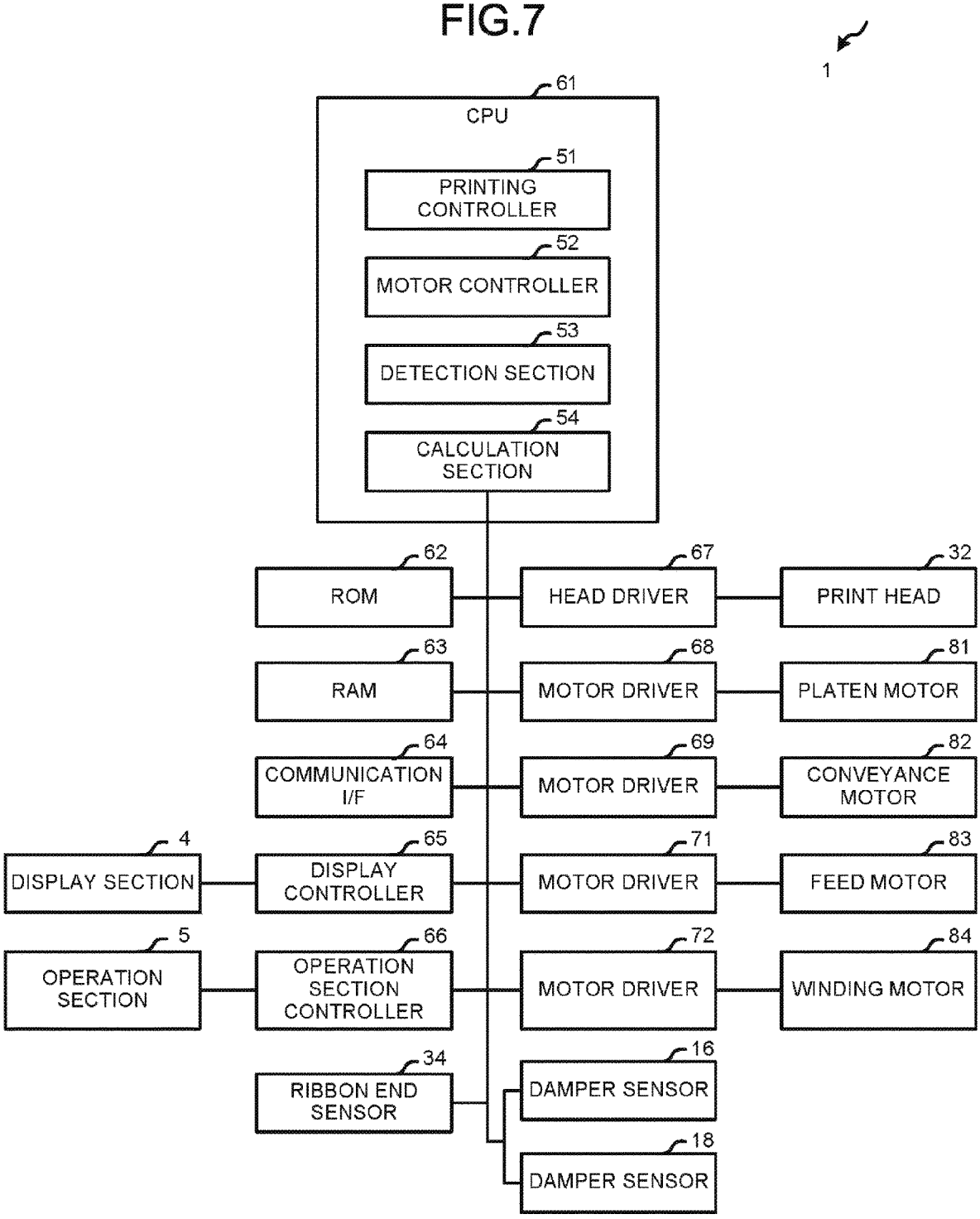
FIG. 7 is a block diagram illustrating a hardware configuration of the printer.

FIG. 7 is a block diagram illustrating the hardware configuration of the printer 1. As shown in FIG. 7, the printer 1 includes a CPU (Central Processing Unit) 61, a ROM (Read Only Memory) 62 and a RAM (Random Access Memory) 63. The CPU 61 is connected to a communication interface (I/F) 64, a display controller 65, an operation section controller 66, a head driver 67, motor drivers 68, 69, 71, and 72, the ribbon end sensor 34, and the damper sensors 16 and 18 via a bus or an interface.

The display section 4 (refer to FIG. 1) is connected to the display controller 65. The operation section 5 (refer to FIG. 1) is connected to the operation section controller 66. The print head 32 (refer to FIG. 2) is connected to the head driver 67. In the print head 32, heating elements are provided in a line in a direction orthogonal to the conveyance direction of the label paper 20. The head driver switches ON/OFF of power distribution to the heating elements of the print head 32 based on print data to thermally transfer a printed image onto the label paper 20.

A platen motor 81 for rotationally driving the platen 31 of the printing section 23 (refer to FIG. 2 for both of them) is connected to the motor driver 68. A conveyance motor 82 which rotationally drives the paper conveyance roller 41 of the paper conveyance section 22 (refer to FIG. 2 for both of them) is connected to the motor driver 69. For example, the conveyance motor 82 may be a Stepping motor or other types of motors.

A feed motor 83 for rotationally driving the ribbon holding shaft 35 (refer to FIG. 2) is connected to the motor driver 71. A winding motor 84 for rotationally driving the ribbon winding shaft 36 (refer to FIG. 2) is connected to the motor driver 72. The feed motor 83 and the winding motor 84 are DC motors, and the CPU 61 controls the input voltage to these DC motors.

The ROM 62 stores programs to be executed by the printer 1 and various kinds of data. The RAM 63 is a memory for copy or decompression in which programs and data are temporarily stored when the CPU 61 executes the various programs. The communication I/F 64 connects the printer 1 to a host computer (not shown) to establish data communication between the printer 1 and the host computer. The host computer transmits the print data (or a print command) to the RAM 63 via the communication I/F 64. The print data may be input via the operation section 5.

Next, the programs to be executed by the printer 1 of the present embodiment are described.

Furthermore, the programs executed by the printer 1 of the present embodiment are provided by being stored in the ROM 62 in advance. The programs executed by the printer 1 of the present embodiment may be provided by being recorded in a computer-readable recording medium such as a CD-ROM (Compact Disc Read-Only Memory), a FD (Flexible Disk), a CD-R (Compact Disk-Recordable), a DVD (Digital Versatile Disk) and the like in the form of installable or executable file.

Furthermore, the programs executed by the printer 1 of the present embodiment may be stored in a computer connected with a network such as the Internet and downloaded via the network to be provided. The programs executed by the printer 1 of the present embodiment may be provided or distributed via the network such as the Internet.

As shown in FIG. 7, the programs executed by the printer of the present embodiment has a module configuration including a printing controller 51, a motor controller 52, a detection section 53 and a calculation section 54. The CPU 61 (processor) reads out the programs from the storage medium such as the ROM 62 to load the above sections on a main storage device (for example, the RAM 63). As a result, the printing controller 51, the motor controller 52, the detection section 53 and the calculation section 54 are generated on the main storage device.

Next, the function of each section is described.

If the print data is input via the communication I/F 64 or the operation section controller 66, the printing controller 51 outputs the print data to the head driver 67, and meanwhile controls the operation of the print head 32 in response to various commands to perform printing on the label paper 20 according to the print data.

The motor controller 52 controls the rotation speed of the Stepping motor for conveying the paper, and the rotation speed of the DC motor for conveying the ink ribbon. Specifically, the motor controller 52 controls the rotational driving of the platen motor 81 via the motor driver 68 and the rotational driving of the conveyance motor 82 via the motor driver 69 to control the conveyance of the paper. The motor controller 52 controls the rotational driving of the feed motor 83 via the motor driver 71 and the rotational driving of the winding motor 84 via the motor driver 72 to control the conveyance of the ink ribbon. The motor controller 52 then controls the rotation speed of each of these motors to synchronize the conveyance speeds of the label paper 20 and the ink ribbon 30 so that the label paper 20 and the ink ribbon 30 are conveyed in the same direction and at the same speed at the printing position.

If the printing controller 51 receives the input of the print data, the motor controller 52 (i.e., a controller or a second controller) performs a ribbon feed initial control processing. The motor controller 52 increases the input voltage applied to the feed motor 83 and the input voltage (second input voltage) applied to the winding motor 84 in stages in the ribbon feed initial control processing. As shown in FIG. 6, the motor controller 52 gradually increases the input voltage applied to the feed motor 83, for example, to 3 V, 6 V, 9 V, 12 V. . . . The processing procedure of the ribbon feed initial control is described later with reference to FIG. 9.

If the axial rotation of the ribbon winding shaft 36 and the ribbon holding shaft 35 starts, the motor controller 52 changes its control from a ribbon feed initial control to a ribbon feed constant control. In the ribbon feed constant control, the motor controller 52 controls rotation of the winding motor 84 and the feed motor 83 at the input voltage which corresponds to the ribbon diameter calculated by the encoder (not shown).

The motor controller 52 forward rotates the winding motor 84 to pull out the ink ribbon 30 from the ribbon holding shaft 35, to feed it to the printing section 23 and to wind the ink ribbon 30 around the ribbon winding shaft 36 in the ribbon feed constant control. In the ribbon feed constant control, the motor controller 52 controls the rotation of the winding motor 84 to apply a back tension to the ink ribbon 30. The motor controller 52 may control the rotation of the feed motor 83 at a rotation speed slower than that of the winding motor 84 to apply a back tension. Alternatively, the motor controller 52 may control the feed motor 83 to rotate in a direction reverse to that of the winding motor 84 to apply a back tension to the ink ribbon 30. In this way, the motor controller 52 holds the ink ribbon 30 in a stretched state between the ribbon holding shaft 35 and the ribbon winding shaft 36.

If the amount of light received by the ribbon end sensor 34 becomes equal to or less than a threshold value for detecting slackness, and the slackness of the ink ribbon 30 is detected, the motor controller 52 reversely rotates the feed motor 83 to tense the ink ribbon 30 between the ribbon winding shaft 36 and the ribbon holding shaft 35. For example, the motor controller 52 stops driving the winding motor 84 when the ribbon feed control is stopped. If the ribbon end sensor 34 detects the slackness of the ink ribbon 30, the motor controller 52 reversely rotates the feed motor 83 while stopping the winding motor 84 to tense the ink ribbon 30 and to remove the slackness of the ink ribbon 30.

The detection section 53 detects the movement of the damper section 17 after the motor controller 52 starts the ribbon feed initial control and starts the control of increasing the input voltage to the winding motor 84 in stages.

The detection section 53 (second detection section) detects the movement of the damper section 15 after the motor controller 52 starts the ribbon feed initial control and starts the control of increasing the input voltage to the feed motor 83 in stages.

Specifically, as shown in FIG. 2 and FIG. 3, the tension of the ink ribbon 30 which gradually increases as the input voltage applied to the winding motor 84 increases balances with a press force of the damper section 15 or the damper section 17 on the ink ribbon 30, and the ink ribbon 30 moves while pushing the damper section 15 or the damper section 17 back. The detection section 53 receives a detection signal indicating switching on or switching off from the damper sensors 16 and 18 when the damper sensors 16 and 18 respectively detect the movement of the damper sections 15 and 17 to detect movement of the damper sections 15 and 17. If the damper sensors 16 and 18 are optical sensors, the detection section 53 detects the movement of the damper sections 15 and 17 based on the received amount of reflected light. Incidentally, the increase of the input voltage to the feed motor 83 and the winding motor 84 is not necessarily in stages and may be changed continuously.

The calculation section 54 uses the input voltage to the feed motor 83 when the detection section 53 detects the movement of the damper section 17 and the elastic characteristics (e.g., elastic force or elastic modulus) of the damper section 17 to calculate the winding diameter (ribbon diameter) of the ink ribbon 30 on the ribbon winding shaft 36 side.

Specifically, the calculation section 54 reads the input voltage when the damper sensor 18 is operated and the damper 173 is moved by being pushed back by the ink ribbon 30. The calculation section 54 calculates the ribbon diameter of the ink ribbon 30 from the following Equation 2 using the read input voltage.

$$F*r=\tau \quad \text{(Equation 2)}$$

F: elastic force by which the damper 173 presses the ink ribbon 30 r: winding radius of the ink ribbon 30

τ: torque with respect to rotation speed 0

The ribbon radius r of the ink ribbon 30 is the winding radius of the ink ribbon 30 on the ribbon winding shaft 36 side with respect to the response of the damper section 17. The torque τ refers to a torque (torque value indicated by the intercept of the horizontal axis in FIG. 6) when the rotation speed is 0, which corresponds to the input voltage applied to the DC motor (winding motor 84) when the detection section 53 detects the movement of the damper section 17.

The calculation section 54 (second calculation section) calculates the ribbon diameter (second ribbon diameter) of the ink ribbon 30 on the ribbon holding shaft 35 side using the input voltage (second input voltage) to the feed motor 83 when the detection section 53 detects the movement of the damper section 15 and the elastic characteristics (e.g., the elastic force or the elastic modulus) of the damper section 15.

The method of calculating the ribbon diameter on the ribbon holding shaft 35 side may be any method as long as the ribbon diameter on the ribbon holding shaft 35 side is calculated using Equation 2 in the same manner as the method of calculating the ribbon diameter on the ribbon winding shaft 36 side described above. In this case, the elastic force F in Equation 2 refers to the elastic force by which the damper (not shown) of the damper section 15 presses the ink ribbon 30. The ribbon diameter r of Equation 2 refers to the winding radius of the ink ribbon 30 on the ribbon holding shaft 35 side. The torque τ in Equation 2 refers to a torque when the rotation speed is 0, which corresponds to the input voltage applied to the DC motor (feed motor 83) when the detection section 53 detects the movement of the damper section 15.

A calculation target may be a winding outer diameter (i.e., diameter) for each shaft or a winding radius for each shaft.

The motor controller 52 (voltage determination section) determines the input voltage applied to each DC motor according to the ribbon diameter of the ink ribbon 30 calculated by the calculation section 54. Specifically, the motor controller 52 determines the input voltage applied to the winding motor 84 according to the ribbon diameter of the ink ribbon 30 on the ribbon winding shaft 36 side. The motor controller 52 (second voltage determination section) determines the input voltage (second input voltage) applied to the feed motor 83 according to the ribbon diameter (second ribbon diameter) of the ink ribbon 30 on the ribbon holding shaft 35 side.

Since a conventional technology can be used for determining the input voltage applied to each DC motor suitable for the ribbon diameter of the ink ribbon 30, the detailed description thereof is omitted.

Next, an example of the procedure of the ribbon feed control processing executed by the printer 1 is described.

Figure 8:
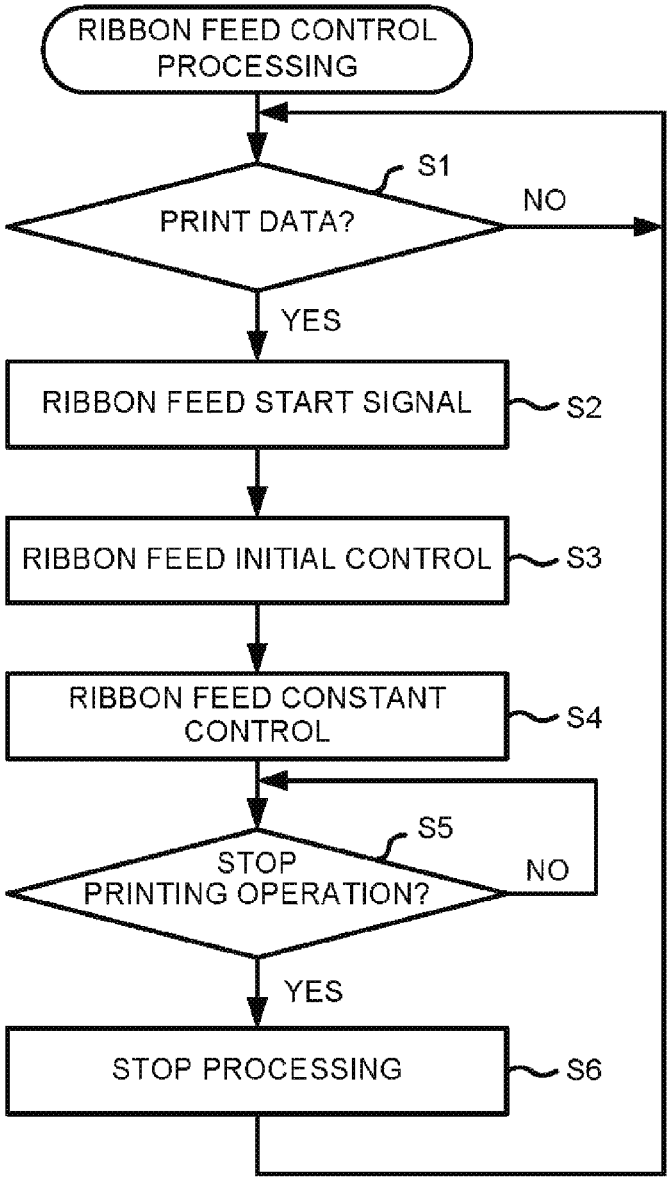
FIG. 8 is a flowchart depicting an example of a procedure of a ribbon feed control processing executed by the printer.

FIG. 8 is a flowchart depicting an example of the procedure of the ribbon feed control processing executed by the printer 1 (CPU 61).

If the print data is input from the communication I/F 64 or the operation section 5 (Yes in Act S1), the motor controller 52 outputs a ribbon feed start signal to the motor drivers 71 and 72 (Act S2) to start the ribbon feed initial control (Act S3). The processing procedure of the ribbon feed initial control in Act S3 is described later with reference to FIG. 9. If the print data is not input (No in Act S1), the CPU 61 stands by in Act S1. If the feed of the ink ribbon 30 is started and the calculation of the ribbon diameter of the ink ribbon 30 by the encoder (not shown) is started after the ribbon feed initial control, the motor controller 52 changes its control to the ribbon feed constant control (Act S4).

The motor controller 52 controls the rotational driving of the feed motor 83 and the winding motor 84 via the motor drivers 71 and 72 to perform the ribbon feed constant control (Act S4). The motor controller 52 controls the platen motor and the conveyance motor 82 to start the rotational driving of the platen 31 and the paper conveyance roller 41 to start the paper feed control. As a result, the label paper 20 is pulled out from the paper holding shaft 21 and conveyed along the conveyance path 24 towards the printing section 23. The motor controller 52 controls the rotation speed of each motor so that the paper conveyance speed and the ribbon feed speed are synchronized with each other.

On the other hand, the printing controller 51 outputs the print data to the head driver 67, and starts a printing operation with the print head 32. If the label paper 20 reaches the position of the print head 32 (the printing position), the printing controller 51 controls a heat generation operation of the print head 32 to start printing based on the print data.

If a stop button (not shown) is operated in the operation section 5, and an instruction to stop the printing operation is received (Yes in Act S5), the motor controller 52 performs a stop processing for stopping the driving of each motor (Act S6). If the printing operation is completed, i.e., if a paper discharge sensor (not shown) provided at the label issuing port 10 detects that the label paper 20 after printing is discharged to the label issuing port 10 (Yes in Act S5), the motor controller 52 performs the stop processing on each motor (Act S6).

In Act S6, the motor controller 52 controls the motor drivers 71 and 72 to stop the feed motor 83 and the winding motor 84. If the slackness of the ink ribbon 30 is detected by the ribbon end sensor 34, the motor controller 52 reversely rotates the winding motor 84 to remove the slackness of the ink ribbon 30. The motor controller 52 controls the motor drivers 68 and 69 to stop driving the platen motor 81 and the conveyance motor 82. The printing controller 51 stops power distribution to the print head 32 to terminate the heat generation operation. If issuing of a plurality of labels is instructed according to a print command, when the discharge of the labels, the number of which is equal to the designated number, is detected, the driving of the motor and the head is stopped.

Next, an example of a processing procedure of the ribbon feed initial control in Act S3 is described.

Figure 9:
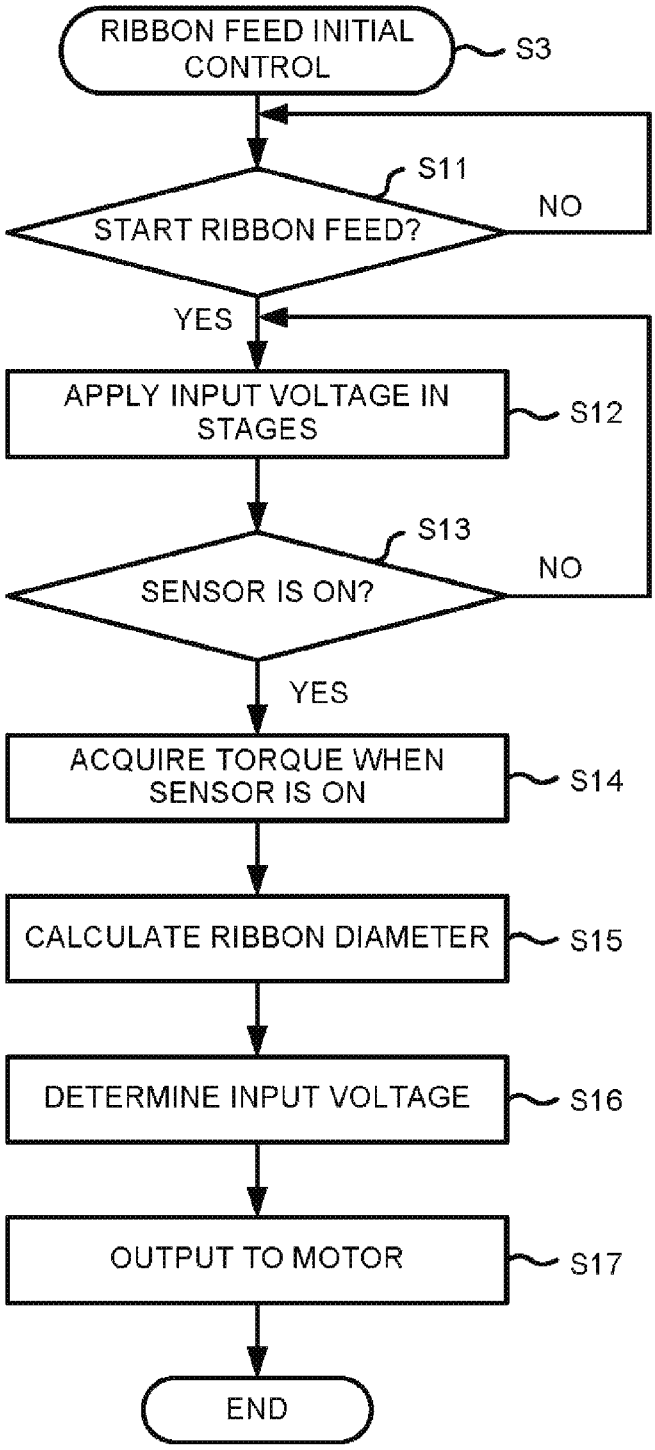
FIG. 9 is a flowchart depicting an example of a processing procedure of a ribbon feed initial control executed by the printer.

FIG. 9 is a flowchart depicting an example of a processing procedure of the ribbon feed initial control executed by the printer 1 (CPU 61). The motor controller 52 performs the processing in Act S11 to Act S17 in FIG. 9 independently for each of the feed motor 83 and the winding motor 84. Since the procedure of the control for each DC motor is the same, in the following, an example of the control on the winding motor 84 is described.

If the print data is input, the motor controller 52 outputs a ribbon feed start signal to the motor driver 72 (Yes in Act S11) and controls the motor driver 72 to start applying the input voltage to the winding motor 84. Specifically, as shown in FIG. 6, the motor controller 52 increases the input voltage to, for example, 3 V, 6 V, 9 V, 12 V, . . . , in stages to apply it to the winding motor 84 (Act S12). If the print data is not input and the ribbon feed is not started (No in Act S11), the CPU 61 stands by in Act S11.

The detection section 53 determines whether the damper sensor 18 is turned on (Act S13). If the damper sensor 18 is not turned on (No in Act S13), the CPU 61 stands by in Act S12. If the damper sensor 18 is turned ON (Yes in Act S13), the calculation section 54 calculates the ribbon diameter on the ribbon winding shaft 36 side using the elastic characteristic of the damper section 17 and the torque $\tau$ (refer to FIG. 6 and Equations 1 and 2) when the rotation speed is 0 which corresponds to the input voltage applied to the winding motor 84 when the damper sensor 18 is turned on (Act S15). The motor controller 52 determines the input voltage applied to the winding motor 84 which corresponds to the ribbon diameter calculated in Act S15 (Act S16). The motor controller 52 outputs and applies the input voltage determined in Act S16 to the winding motor 84 (Act S17), and then terminates the processing of the ribbon feed initial control. Thereafter, the flow proceeds to the processing in Act S4 in FIG. 8 to perform the ribbon feed constant control.

As described above, according to the present embodiment, since the ribbon diameter can be calculated from the operations of the damper sections 15 and 17 and the balance of forces immediately before the ribbon feed operation is started, the actual ribbon diameter for each shaft can be estimated before the rotation of the ribbon holding shaft 35 and the ribbon winding shaft 36 is started. Therefore, a more appropriate input voltage corresponding to the actual ribbon diameter is applied to the DC motors (the winding motor 84 and the feed motor 83) for rotationally driving the ribbon holding shaft 35 and the ribbon winding shaft 36, and the initial conveyance speed of the ink ribbon 30 can be adjusted more accurately.

As described above, while certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

For example, in the above description, the damper sections 15 and 17 and the damper sensors 16 and 18 are separately provided on the ribbon winding shaft 36 side and the ribbon holding shaft 35 side to separately calculate the ribbon diameters for the respective shafts. The embodiment is not limited thereto. For example, a pair of a damper section and a damper sensor may be provided on either the ribbon winding shaft 36 side or the ribbon holding shaft 35 side to calculate the corresponding one ribbon diameter. Then, it is assumed that the CPU 61 has a reception section for receiving an input of a ribbon diameter (i.e., an initial value of the ribbon diameter) of a ribbon roll to be placed around the ribbon holding shaft 35. Then, the other ribbon diameter may be calculated by subtracting the ribbon diameter calculated as described above according to the initial value of the ribbon diameter received by the reception section from the initial value of the ribbon diameter.

For example, the calculation section 54 may calculate the ribbon diameter on the ribbon holding shaft 35 side by subtracting the ribbon diameter on the ribbon winding shaft side calculated as in the above embodiment from the initial value of the ribbon diameter described above.

In the above description, the DC motor is provided on the ribbon winding shaft 36 and the ribbon holding shaft 35, but the embodiment is not limited thereto. For example, a DC motor may be provided only on the ribbon winding shaft 36, and the shaft of the ribbon holding shaft 35 may follow the ribbon winding shaft 36. In this case, it is sufficient that the damper portion 17 and the damper sensor 18 are provided only on the ribbon winding shaft 36 side as the damper portion and the damper sensor. In this case, the calculation section 54 may calculate only the ribbon diameter on the winding shaft 36 side.

In the above description, the ON and OFF of the damper sensors 16 and 18 are switched depending on a contact state with the damper sections 15 and 17, respective; however, the embodiment is not limited thereto. For example, it is possible to detect the movement of the damper sections 15 and 17 using optical sensors or the like as the damper sensors 16 and 18. Specifically, a distance between the damper section 15 or 17 (a cylindrical portion 152 (not shown) or the cylindrical portion 172) and the damper sensor 16 or 18 is measured to detect that the damper section 15 or 17 (the cylindrical portion 152 (not shown) or the cylindrical portion 172) and the damper sensor 16 or 18 are separated from each other, respectively. The damper sensor 16 or 18 is turned off when they are separated from each other, and is turned on when the distance therebetween becomes an approach or contact distance which is equal to or less than a predetermined distance.

For example, in the above description, as an example of the printer of the present embodiment, a label printer that performs printing on the label paper wound in a roll shape is applied; however, the embodiment is not limited thereto. The print medium is not limited to the label paper, and may be another print medium such as a tag paper, a receipt paper, etc., and the printer may be a printer that performs printing on another print medium such as a tag paper, a receipt paper, etc. The print medium is not limited to a medium wound in a roll shape, and may be a sheet-like medium, and the printer may be a printer that feeds the sheet-like print medium to the printing section.

In the embodiment described above, the printer of the thermal transfer system (thermal printer) using a thermal transfer ribbon as the ink ribbon is used, but the above embodiment may be applied to other types of printers using the ink ribbon. For example, the present embodiment may be applied to a typewriter or a printer of the impact dot system to automatically eliminate the slackness of the ink ribbon, thereby improving the printing quality.

What is claimed is:

1. A printer, comprising:

a ribbon holding shaft around which an ink ribbon is wound;

a ribbon winding shaft around which the ink ribbon pulled from the ribbon holding shaft is wound;

a printing section configured to print using the ink ribbon and a print head on a print medium conveyed to a printing position where the print head and a platen face each other;

a winding motor configured to rotationally drive the ribbon winding shaft;

a damper section, provided on a conveyance path of the ink ribbon between a position where the ink ribbon is pulled from the ribbon holding shaft and a position where the ink ribbon is wound around the ribbon winding shaft through the printing position, configured to elastically abut against the ink ribbon when conveyance of the ink ribbon is stopped;

a controller configured to control an operation of increasing an input voltage applied to the winding motor;

a detection section configured to detect movement of the damper section;

a calculation section configured to calculate a winding diameter of the ink ribbon wound on the ribbon winding shaft side using the input voltage when the movement of the damper section is detected and characteristics of the damper section; and a voltage determination section configured to determine an input voltage to be applied to the winding motor according to the calculated winding diameter.

2. The printer according to claim 1, wherein the detection section detects movement of the damper section with a switch mechanism.

3. The printer according to claim 1, wherein the detection section detects movement of the damper section using an optical sensor.

4. The printer according to claim 1, further comprising:

a feed motor configured to rotationally drive the ribbon holding shaft;

a second damper section, provided on the conveyance path between the ribbon holding shaft and the printing position;

a second controller configured to control an operation of increasing a second input voltage applied to the feed motor;

a second detection section configured to detect movement of the second damper section after the second controller starts increasing the second input voltage;

a second calculation section configured to calculate a second ribbon diameter which is a winding diameter of the ink ribbon wound on the ribbon holding shaft side using the second input voltage when the second damper section moves and characteristics of the second damper section; and a second voltage determination section configured to determine a second input voltage which is an input voltage to be applied to the feed motor according to the calculated second ribbon diameter.

5. The printer according to claim 4, wherein the second detection section detects movement of the second damper section with a switch mechanism.

6. The printer according to claim 4, wherein the second detection section detects movement of the second damper section using an optical sensor.

7. The printer according to claim 1, further comprising:

a feed motor configured to rotationally drive the ribbon holding shaft; and a reception section configured to receive input of an initial value of a ribbon diameter of a ribbon roll set around the ribbon holding shaft, wherein the calculation section calculates the winding diameter of the ink ribbon wound on the ribbon holding shaft side by subtracting the winding diameter on the ribbon winding shaft side calculated by the calculation section from the initial value of the ribbon diameter, and the voltage determination section determines an input voltage to be applied to the feed motor according to the winding diameter of the ink ribbon on the ribbon holding shaft side calculated by the calculation section.

8. A winding method for a printer, comprising:

conveying a print medium conveyed to a printing position using a print head and a platen facing each other;

printing on the print medium using an ink ribbon, the ink ribbon wound around a ribbon holding shaft and pulled from the ribbon holding shaft to a ribbon winding shaft around which the ink ribbon is wound;

rotationally driving the ribbon winding shaft;

on a conveyance path of the ink ribbon between a position where the ink ribbon is pulled from the ribbon holding shaft and a position where the ink ribbon is wound around the ribbon winding shaft through the printing position, elastically abutting a damper section against the ink ribbon when conveyance of the ink ribbon is stopped;

controlling an amount of an input voltage applied to the winding motor;

detecting movement of the damper section;

calculating a winding diameter of the ink ribbon wound on the ribbon winding shaft side using the input voltage when the movement of the damper section is detected and characteristics of the damper section; and determining an input voltage to be applied to the winding motor according to the calculated winding diameter.

9. The winding method according to claim 8, further comprising:

detecting movement of the damper section with a switch mechanism.

10. The winding method according to claim 8, further comprising:

Detecting movement of the damper section using an optical sensor.

11. The winding method according to claim 8, further comprising:

rotationally driving the ribbon holding shaft;

controlling an amount of a second input voltage applied to the feed motor;

detecting movement of a second damper section after the second controller starts increasing the second input voltage, the second damper section provided on the conveyance path between the ribbon holding shaft and the printing position;

calculating a second ribbon diameter which is a winding diameter of the ink ribbon wound on the ribbon holding shaft side using the second input voltage when the second damper section moves and characteristics of the second damper section; and determining a second input voltage which is an input voltage to be applied to the feed motor according to the calculated second ribbon diameter.

12. The winding method according to claim 11, further comprising:

detecting movement of the second damper section with a switch mechanism or an optical sensor.

13. The winding method according to claim 8, further comprising:

rotationally driving the ribbon holding shaft; and receiving input of an initial value of a ribbon diameter of a ribbon roll set around the ribbon holding shaft, wherein calculating the winding diameter of the ink ribbon wound on the ribbon holding shaft side by subtracting the winding diameter on the ribbon winding shaft side calculated from the initial value of the ribbon diameter, and determining an input voltage to be applied to the feed motor according to the winding diameter of the ink ribbon on the ribbon holding shaft side calculated.

14. A thermal printer, comprising:

a ribbon holding shaft around which an ink ribbon is wound;

a ribbon winding shaft around which the ink ribbon pulled from the ribbon holding shaft is wound;

a thermal printing section configured to print using the ink ribbon and a thermal print head on a print medium conveyed to a printing position where the thermal print head and a platen face each other;

a winding motor configured to rotationally drive the ribbon winding shaft;

a damper section, provided on a conveyance path of the ink ribbon between a position where the ink ribbon is pulled from the ribbon holding shaft and a position where the ink ribbon is wound around the ribbon winding shaft through the printing position, configured to elastically abut against the ink ribbon when conveyance of the ink ribbon is stopped;

a controller configured to control an operation of increasing an input voltage applied to the winding motor;

a detection section configured to detect movement of the damper section;

a calculation section configured to calculate a winding diameter of the ink ribbon wound on the ribbon winding shaft side using the input voltage when the movement of the damper section is detected and characteristics of the damper section; and a voltage determination section configured to determine an input voltage to be applied to the winding motor according to the calculated winding diameter.

15. The thermal printer according to claim 14, wherein the detection section detects movement of the damper section with a switch mechanism.

16. The thermal printer according to claim 14, wherein the detection section detects movement of the damper section using an optical sensor.

17. The thermal printer according to claim 14, further comprising:

a feed motor configured to rotationally drive the ribbon holding shaft;

a second damper section, provided on the conveyance path between the ribbon holding shaft and the printing position;

a second controller configured to control an operation of increasing a second input voltage applied to the feed motor;

a second detection section configured to detect movement of the second damper section after the second controller starts increasing the second input voltage;

a second calculation section configured to calculate a second ribbon diameter which is a winding diameter of the ink ribbon wound on the ribbon holding shaft side using the second input voltage when the second damper section moves and characteristics of the second damper section; and a second voltage determination section configured to determine a second input voltage which is an input voltage to be applied to the feed motor according to the calculated second ribbon diameter.

18. The thermal printer according to claim 17, wherein the second detection section detects movement of the second damper section with a switch mechanism.

19. The thermal printer according to claim 17, wherein the second detection section detects movement of the second damper section using an optical sensor.

20. The thermal printer according to claim 14, further comprising:

a feed motor configured to rotationally drive the ribbon holding shaft; and a reception section configured to receive input of an initial value of a ribbon diameter of a ribbon roll set around the ribbon holding shaft, wherein the calculation section calculates the winding diameter of the ink ribbon wound on the ribbon holding shaft side by subtracting the winding diameter on the ribbon winding shaft side calculated by the calculation section from the initial value of the ribbon diameter, and the voltage determination section determines an input voltage to be applied to the feed motor according to the winding diameter of the ink ribbon on the ribbon holding shaft side calculated by the calculation section.

* * * * *